US009597689B2

(12) United States Patent
Link

(10) Patent No.: US 9,597,689 B2
(45) Date of Patent: Mar. 21, 2017

(54) CONTAINER HOLDER

(75) Inventor: Holger Link, Hamburg (DE)

(73) Assignee: EPPENDORF AG, Hamburg (DE)

( * ) Notice: Subject to any disclaimer, the term of this patent is extended or adjusted under 35 U.S.C. 154(b) by 1763 days.

(21) Appl. No.: 11/996,802

(22) PCT Filed: Jul. 21, 2006

(86) PCT No.: PCT/EP2006/007217

§ 371 (c)(1),
(2), (4) Date: Mar. 19, 2009

(87) PCT Pub. No.: WO2007/012437

PCT Pub. Date: Feb. 1, 2007

(65) Prior Publication Data

US 2010/0143197 A1 Jun. 10, 2010

(30) Foreign Application Priority Data

Jul. 28, 2005 (DE) ..... 10 2005 035 335

(51) Int. Cl.
*B01L 9/06* (2006.01)
*B01L 9/00* (2006.01)

(52) U.S. Cl.
CPC ..... *B01L 9/06* (2013.01); *B01L 9/523* (2013.01); *B01L 2200/023* (2013.01); *B01L 2200/12* (2013.01); *B01L 2300/0829* (2013.01); *B01L 2300/123* (2013.01)

(58) Field of Classification Search
None
See application file for complete search history.

(56) References Cited

U.S. PATENT DOCUMENTS

| | | | | |
|---|---|---|---|---|
| 3,709,429 | A | 1/1973 | McKenzie et al. | |
| 4,588,158 | A * | 5/1986 | Mehra | 249/64 |
| 5,133,939 | A | 7/1992 | Mahe | |
| 5,366,088 | A * | 11/1994 | Hill et al. | 206/499 |
| 5,579,929 | A | 12/1996 | Schwartz | |
| 5,852,972 | A * | 12/1998 | Wolstenholme | 101/41 |
| 5,996,818 | A | 12/1999 | Boje et al. | |
| 6,019,225 | A * | 2/2000 | Kalmakis et al. | 206/563 |
| 6,533,133 | B2 | 3/2003 | Liu | |
| 6,685,555 | B1 * | 2/2004 | Davis et al. | 454/155 |
| 6,875,405 | B1 | 4/2005 | Mathus et al. | |
| 2002/0068022 | A1 * | 6/2002 | Schneider | 422/104 |
| 2002/0170867 | A1 | 11/2002 | Liu | |
| 2005/0265901 | A1 * | 12/2005 | Sinclair et al. | 422/104 |

FOREIGN PATENT DOCUMENTS

| | | |
|---|---|---|
| CH | 656211 A5 | 6/1986 |
| DE | 8106891 U | 9/1981 |
| DE | 8106891 U1 | 9/1981 |
| DE | 10245961 | 4/2004 |
| WO | WO 95/06607 | 3/1995 |

* cited by examiner

*Primary Examiner* — Paul Hyun
(74) *Attorney, Agent, or Firm* — Todd A. Lorenz

(57) ABSTRACT

A container holder for a multiplicity of tubular sample containers with a frame made of a rigid plastic material, comprising a panel with a multiplicity of holes, and a coating of the frame which is made of an elastic plastic material or of rubber, and which partially closes off the cross section of the holes.

13 Claims, 4 Drawing Sheets

CONTAINER HOLDER

CROSS REFERENCE TO RELATED APPLICATIONS

Figure 1:
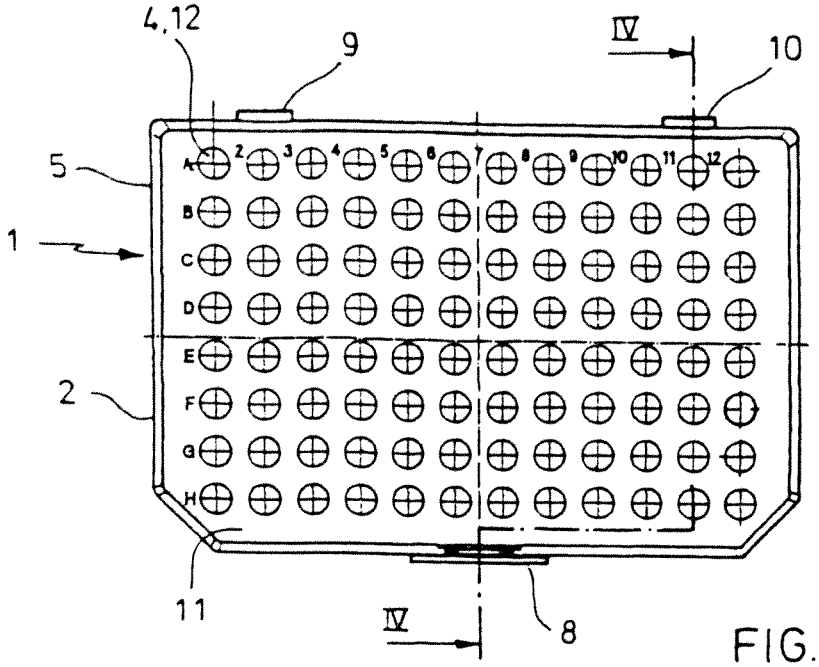

This is the National Stage filed under 35 U.S.C. §371 of International Application PCT/EP2006/007217 filed on Jul. 21, 2006, which designated the United States of America, the disclosure of which is incorporated herein by reference. The present application claims priority from German Patent Application No 10 2005 035 335.5 filed on Jul. 28, 2005, the contents of which are incorporated herein by reference.

The present invention is related to a container holder for a multiplicity of tubular sample containers.

Container holders (also called "racks") are used in the laboratory for storing and keeping at hand sample containers for different processings. For instance, samples are metered into the sample containers or taken out of the sample containers, the samples are maintained on a predetermined temperature in the sample containers, subjected to a measurement or mixed.

The mixing of the samples takes frequently place by setting up the container holder on the shaking table of a mixer. In this, it is important that the sample containers keep their position in the container holder, do not open themselves and are not thrown out, so that sample losses occur.

Sample containers with a capacity of 0.2 ml, 0.5 ml, 1.5 ml and 2.0 ml are very wide-spread. The containers of different manufacturers mostly have different dimensions, even when they have the same capacity. Therefore, frequently no suitable container holders are at hand in the laboratory operation, when sample containers of different manufacturers are used. This holds especially when the sample containers in the container holder are to be set up on a mixer, because in this, a secure seat of the sample containers in the container holder is important.

Based on these facts, the present invention is based on the objective to provide a container holder which permits to hold sample containers of different dimensions in a safe way, even when the sample containers in the container holder are shaken by a mixer.

The objective is resolved by a container holder with the features of claim 1. Advantageous embodiments of the container holder are indicated in subclaims.

The container holder for a multiplicity of tubular sample containers according to the present invention has a frame made of a rigid plastic material and comprising a panel with a multiplicity of holes, and a coating of the frame which is made of an elastic plastic material or of rubber, and which partially closes off the cross section of the holes.

Tubular sample containers can be inserted into the holes of the per se rigid container holder under elastic deformation of the coating. As a consequence, the sample containers are elastically fixed on the perimeter. In doing so, different dimensions are compensated by the elastic deformation of the coating. Thus, sample containers with different dimensions can be securely clamped into the container holder. This makes it possible to mix different sample containers in the same container holder, without that sample losses occur. Also, the containers are prevented from being thrown out by centrifugal force during shaking in the mixer by the elastic fixation of the sample containers. For metering in liquids, the containers can be inserted into the holes only partially, so that the metering process can be visually observed in a better way. Further, by the elastic fixation it is possible to keep sample containers with a lid in an orientation in which the opened lids are not arranged above the openings of neighbouring sample containers. Further, the elastic clamping prevents any jumping up of the sample containers when the container holder receives a push or when an impulse is led into the container holder by closing the lid of a neighbouring sample container. Throwing up the sample liquid up to the lid, which might result in a sample loss, is also avoided by doing so.

In principle, it is sufficient when the coating is disposed only at the holes, and the regions of the panel between the holes are realised without coating. Further, the coating might extend around the whole perimeter or only a part of the perimeter of the holes. For instance, with circular holes it is sufficient when the coating partially covers the cross section of the holes at three positions radially projecting towards the inside and being set-off for about 120°. According to one embodiment, the coating substantially covers the upper side of the panel. By doing so, the coating process of the panel is facilitated and a secure connection of the coating with the panel is assisted.

As already set forth, the coating can have projections, which protrude into the cross section of the holes. According to one embodiment, the coating leaves a circular part of the cross section of the holes uncovered. For instance, the coating has circular holes in this, which are preferably concentric to the holes of the frame, or the circular part of the cross section is present in a circle touched by the projections.

According to a further embodiment, the circular part of the cross section has a diameter of about 5.8 mm or of about 7.5 mm or of about 10.6 mm. The applicant company has found out that clamping in a great part of the commercially available containers having a capacity of 0.2 ml is possible at the first indicated diameter, that most of the commercially available containers having a capacity of 0.5 ml can be clamped in at the second diameter, and that the third indicated diameter permits to clamp in most of the commercially available containers having a capacity of 1.5 ml to 2.0 ml.

According to one embodiment, the diameter deviates from the previously indicated numerical values about ±0.1 mm at maximum. Preferably, possible deviations from the numerical values are limited to the usual manufacturing tolerances.

It is possible to dispose the coating on the lower side or on the upper side of the panel. Further, the coating can be disposed on the inner perimeter of the holes. The previously mentioned embodiments can also be combined arbitrarily, i.e. a coating on the upper side or on the lower side with a coating on the inner perimeter, or a coating on the upper side and on the lower side with a coating on the inner perimeter. According to an embodiment, the coating is arranged solely on the upper side of the panel. This has advantages in the manufacturing process and it saves material.

For the coating, rubber and various elastic plastic materials come into consideration. According to one embodiment, the coating is made of an elastomer or of a thermoplastic elastomer. According to a further embodiment, the coating is made from a silicone or of EPDM.

The force by which a sample container is elastically fixed in the container holder depends on the thickness of the coating in particular. According to one embodiment, the coating has a thickness of about 1 to 3 mm.

Further, the force depends on the hardness of the coating. Preferably, it has a hardness of about 60 to 70 Shore A.

The holes of the panel can have different shapes, a polygonal cross section for instance. Preferably, the holes of the panel are circular.

According to one embodiment, the panel has separator bridges on the lower side of the openings, which mostly surround at least partly. The separator bridges can laterally support the sample containers in the holes, in order not to permit that they adopt extremely inclined positions upon acceleration in the mixer, which might lead to sample losses. Further, they make the frame stiffer.

According to one embodiment, the holes are arranged in parallel rows and in parallel columns directed vertically to the rows. This matrix arrangement of the containers facilitates several processings, like filling and depleting by means of a multichannel pipette. In addition, the matrix arrangement permits the accommodation of microtiter plates with containers projecting from the lower side in the container holder.

According to a further embodiment, which favours the accommodation of microtiter plates, the panel of the container holder has 25 or 96 or 384 or 1536 holes, corresponding to the popular numbers of the accommodations of container plates or microtiter plates. According to a further embodiment, the panel has 8 holes or a multiple of the mentioned numbers of holes, in order to accommodate container strips.

In principle, it is possible to realise the container holder with only one panel, which can be held in a mixer. According to one embodiment, the frame has a skirt, connected to the brim of the panel and projecting from the lower side of the panel. The skirt serves for setting up or fixing, respectively, of the container holder on a bottom base.

According to one embodiment, the skirt has locking edges parallel to the panel. The locking edges serve for the fixation of the container holder, which takes place by means of elastic springs of a mixer, for instance.

For instance, the locking edges are the lower brims of cut-outs or holes of the skirt. According to one embodiment, the locking edges are present on joint bars of the skirt, which project towards the outside. The joint bars projecting towards the outside facilitate the fixation of the container holders in a mixer.

According to one embodiment, the locking edges are arranged in the vicinity of the lower brim of the skirt, so that the locking elements do not impede the grip onto the container holder.

According to a further embodiment, at least one locking edge is arranged about in the centre of a long side of the skirt. According to a further embodiment, the skirt has a deepening about as big as a finger tip above the locking edge in the centre of the skirt. The locking of the container holder by means of a spring hook can be released by pressing the skirt in the region of the deepening about as big as a finger tip. In this region, the skirt can be easily deformed elastically, so that the spring hook slips off from the joint bar.

According to a further embodiment, at least two locking edges are arranged in the vicinity of the ends of a further long side of the skirt. These locking edges are movable in order to fix the container holder below stationary hooks of a mounting equipment.

According to one embodiment, the skirt is inclined away from the panel on its long sides and/or its transverse sides. This facilitates manufacture, the release from an injection moulding tool for instance.

According to one embodiment, the material of the frame is polycarbonate or polystyrene or polypropylene.

According to one embodiment, the container holder is an injection moulded part.

The present invention embraces embodiments, in which the frame and the coating are produced separately and are connected to each other via gluing, latching, pins in the hard component or other fastening methods.

Finally, according to one embodiment, the container holder is a two-component injection moulded part. When the materials of the frame and the coating are suitably selected, a sufficient connection between frame and coating can be produced directly in the two-component injection moulding process. However, the connection between frame and coating can be also made sure by using a bonding agent.

For instance, the container holder can be used as a tabletop handling system, as an adapter for centrifuges or for holding containers on a (thermo-) mixer.

In the following, the present invention is explained in more detail by means of the attached drawings of an example of its realisation.

Figure 2:
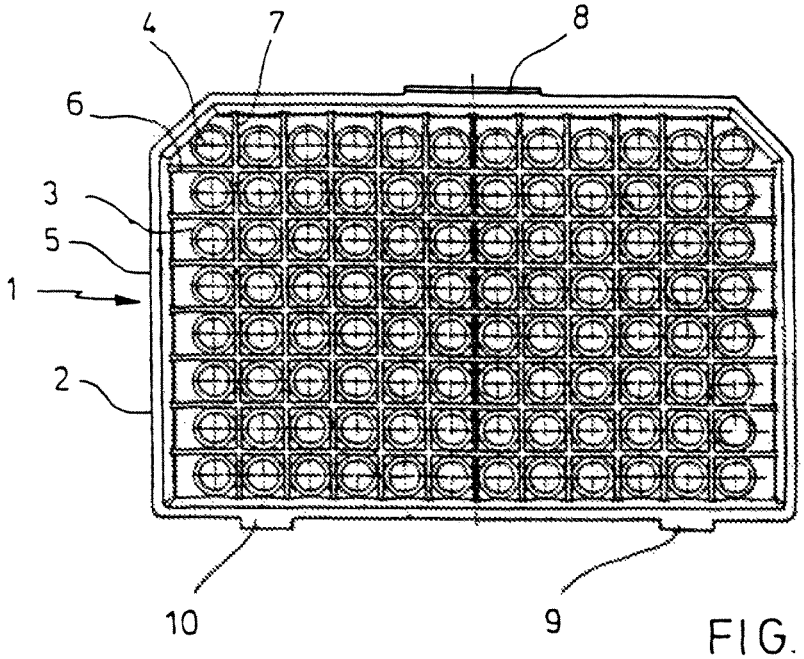
Figure 3:
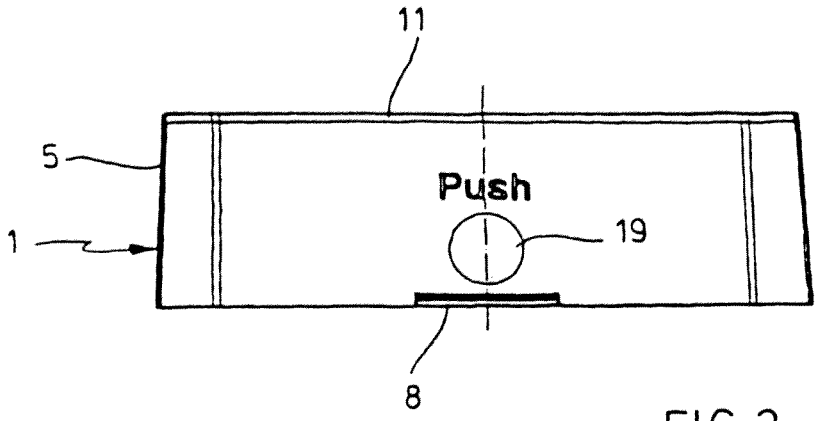
Figure 4:
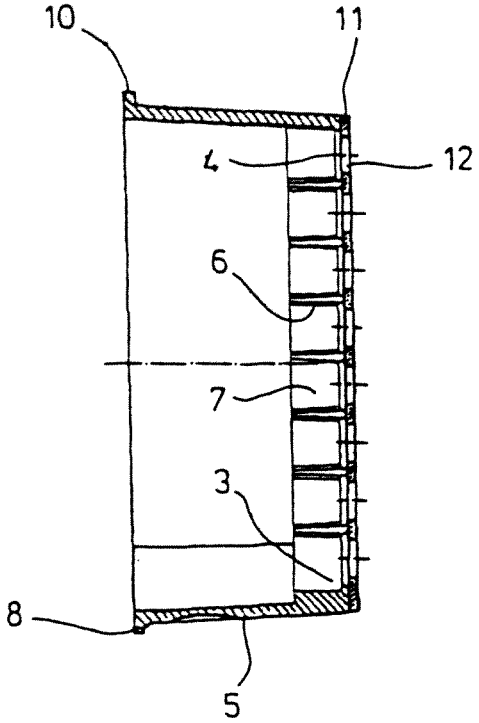
Figure 5:
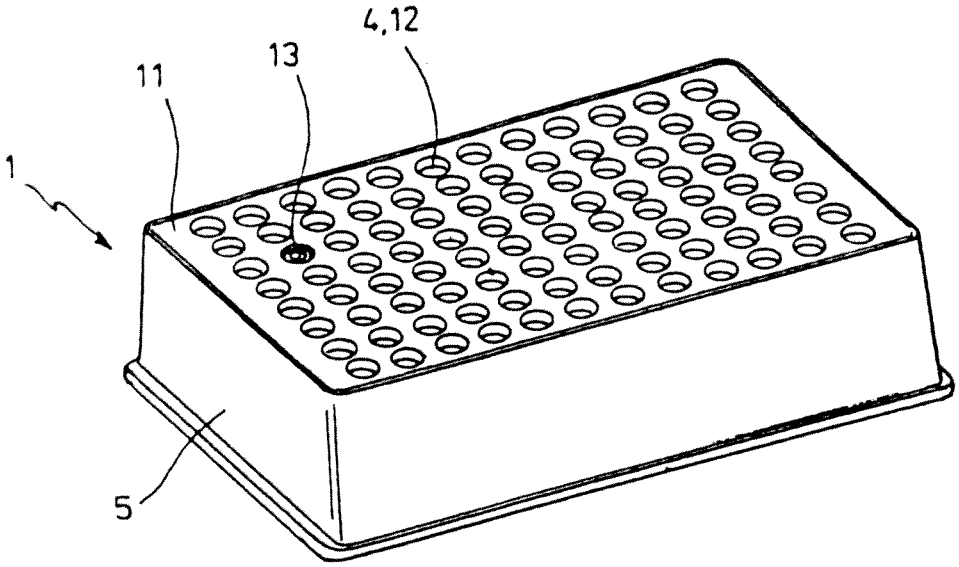
Figure 6:
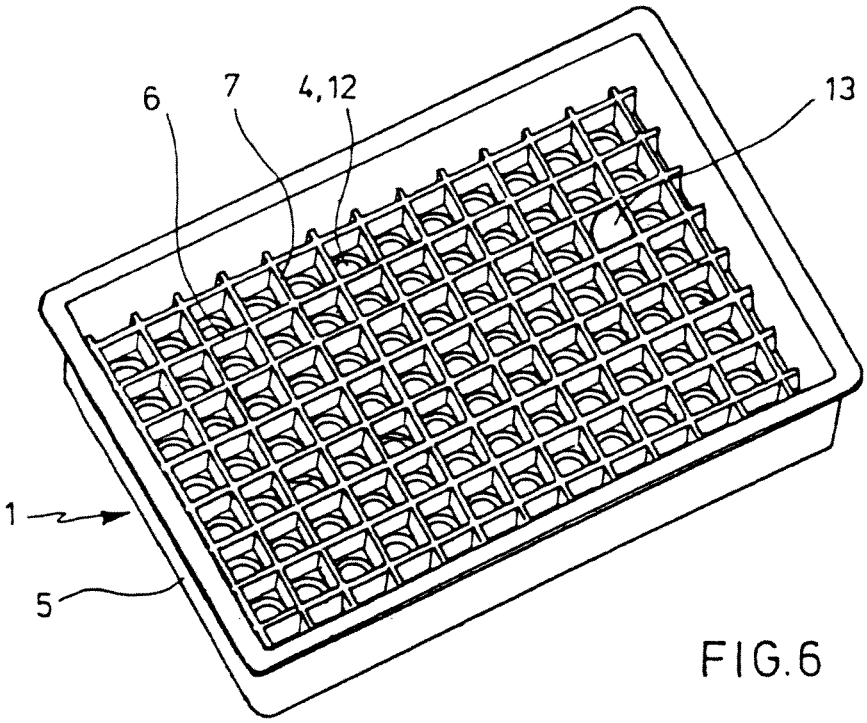
Figure 7:
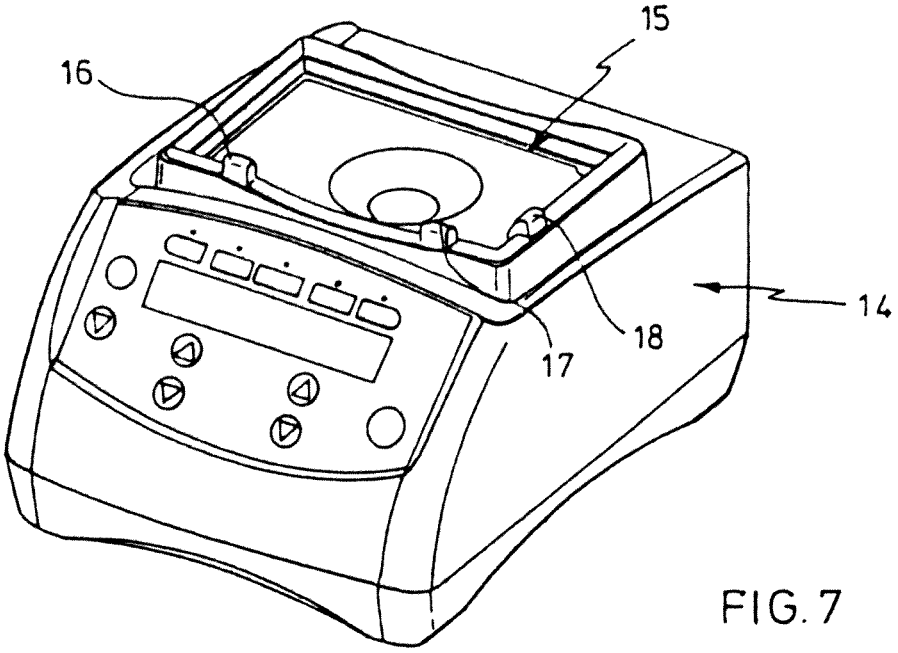
Figure 8:
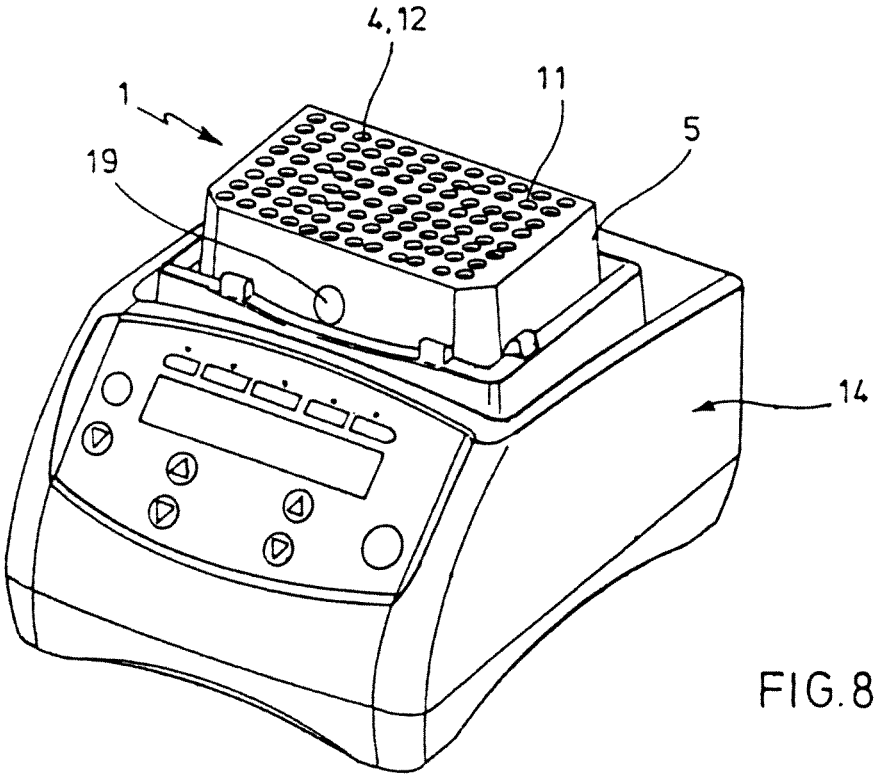

In the drawings show:

FIG. 1 a container holder in the top view;

FIG. 2 the same container holder in the view from the bottom side;

FIG. 3 the same container holder in a front view;

FIG. 4 the same container holder in a section along the line IV-IV of FIG. 1;

FIG. 5 the same container holder in a perspective view, skew from the top and from the side;

FIG. 6 the same container holder in a perspective view, skew from the bottom and from the side;

FIG. 7 a thermo-mixer in a perspective view skew from the top;

FIG. 8 the same thermo-mixer with set-up container holder according to FIG. 1-6.

The container holder shown in FIGS. 1 to 6 has a frame 2. The same comprises a panel 3, in which 96 holes 4 are arranged in eight rows and 12 columns.

The frame 2 has a skirt 5, connected to the brim of the panel 3 and projecting from the lower side of the panel 3. The skirt 5 circulates completely around the brim of the panel 3. At all sides, it is inclined away from the panel 3 about an angle of a few degrees.

From the lower side of the panel 3 project separation bridges 6, 7, which separate the holes 4 from each other, running in rows and columns and extending up to the inner sides of the skirt 5. Thus, the lower side of the panel 3 is shaped to be honeycomb-like.

On the centre of a longitudinal side on the lower brim, the skirt 5 has a projecting joint bar 8. In the vicinity of the ends of the opposed longitudinal side, also on the lower brim, it has two shorter projecting joint bars 9, 10.

The frame 2 is injection-moulded in one piece from polycarbonate.

The topside of the panel 3 supports a coating 11 made of an elastic material, which covers it in a planar way. The coating 11 is attached solely on the topside of the panel 3 and it has a thickness of about 1.5 mm. It has holes 12 concentric to the holes 4 of the panel 3, which have a smaller diameter than the holes 4, however. As a consequence, the cross section of the holes 4 is partially closed off by the brim region of the coating 11 which limits the holes 12.

The coating 11 is comprised of silicone or an elastomer or a thermoplastic elastomer. It has a hardness of about 60 Shore A. The coating 11 is injection moulded.

The whole container holder 1, comprised of frame 2 and coating 11 is produced by two-component injection moulding.

According to FIGS. 5 and 6, a tubular sample container 13 is clamped into a hole 4 of the container holder 1. Approximately in its centre region, the sample container 13 has an outer diameter which exceeds a little bit the inner diameter of the hole 12. As a consequence, the hole 12 is radially expanded elastically and the sample container is fixed in the hole 4 by clamping, without having contact with the inner perimeter of the hole 4.

The container 13 is secured against tilting in the hole 4 by the separation bridges 6, 7 and the skirt 5 surrounding the outer holes 4. Furthermore, the separation bridges 6, 7 stiffen the panel 3, so that the same does not bend when clamping laboratory containers 13.

All the holes 4 of the container holder 1 can be equipped with containers 13 in the described way. In this, the containers 13 may be aligned such that a lid articulated on the same by means of a hinge is directed about an angle of approximately 45° with respect to the longitudinal sides of the panel 3 in its opened condition, and thus it does not cover neighbouring containers 13.

The container holder 1 equipped with containers 13 can be used for storing or keeping at hand the containers 13 for different processings, like metering and taking out liquids, for instance.

According to FIGS. 7 and 8, the containers 13 in the container holder 1 can be positioned on a thermo mixer 14, which maintains the samples at a predetermined temperature and shakes them. The thermo mixer 14 has a shaking table 15, which is movable along a horizontal course or a three-dimensional course, driven by a not shown motor. For instance, the same is movable along a circular course or it performs a tumbling movement.

The thermo mixer 14 has a shaking table with a universal panel holder 15 with spring clamps 16, 17, 18, below which microtiter plates or deepwell plates can be locked into place. The container holder 1 is secured on the joint bars in cut-outs of the universal plate holder 15, so that the container holder 1 and the sample containers 13 inserted into it take part in the shaking movement of the shaking table. The container holder 1 is elastic and provides for being clamped in the cut-outs by it self. The sample containers 13 are sufficiently secured in the container holder 1 by the elastic fixation, so that they are not driven out of the container holder 1 due to the acceleration when they are shaken.

In order to detach the container holder 1 from the thermo mixer 14, it can be pressed against a deepening 19 in a longitudinal side of the skirt 5. By doing so, the skirt 5 forms an arc towards the inside, so that the joint bar 8 is released from a cut-out and the container holder 1 can be pulled out of the further cut-outs by the further joint bars 9, 10.

The invention claimed is:

1. A container holder for a multiplicity of tubular sample containers (13) with a frame (2) made of a rigid plastic material, comprising a panel (3) with a brim and a multiplicity of holes (4) extending from the upper to the lower surface of the panel, a skirt which is connected to the brim of the panel (3) and projects from the lower side of the panel (3) and a coating (11) partially closing off the cross section of the holes (4) in the panel (3), characterized in that the skirt (5) has locking edges parallel to the panel (3) and the coating (11) has a thickness of about 1 to 3 mm and a hardness of about 50 to 70 Shore A and comprises a material selected from the group consisting of an elastomer, a thermoplastic elastomer, silicone, and EPDM, wherein the coating (11) substantially covers the upper side of the panel (3) and wherein the coating is exclusively arranged at the upper side of the panel (3).

2. The container holder according to claim 1, wherein the coating (11) leaves a circular part (12) of the cross section of the holes (4) uncovered.

3. The container holder according to claim 2, wherein the circular part (12) of the cross section has a diameter of about 5.8 mm or of about 7.5 mm or of about 10.6 mm.

4. The container holder according to claim 1, wherein the coating (11) has a hardness of about 60 to 70 Shore A.

5. The container holder according to any one of claims 1 to 3, wherein the panel (3) has separator bridges (6, 7) on its lower side, which at least partly surround the holes (4).

6. The container holder according to any one of claims 1 to 3, wherein the holes (4) are arranged in parallel rows and in parallel columns directed vertically to the rows.

7. The container holder according to any one of claims 1 to 3, wherein the locking edges are present on joint bars (8, 9, 10) of the skirt (5), which project towards the outside.

8. The container holder according to any one of claims 1 to 3, wherein at least one locking edge is arranged about in the centre of a long side of the skirt (5).

9. The container holder according to claim 8, wherein the skirt (5) has a deepening (19) about as big as a finger tip above the locking edge.

10. The container holder according to claim 8, wherein at least two locking edges are arranged in the vicinity of the ends of a further long side of the skirt (5).

11. The container holder according to any one of claims 1 to 3, wherein the material of the frame (2) is polycarbonate or polystyrene or polypropylene.

12. The container holder according to claim 1, wherein the skirt (5) has locking edges parallel to the panel (3).

13. The container holder according to claim 1, wherein the container holder is a two-component injection molded part and the frame (2) and coating (11) are produced and connected directly during the two-component injection molding process.

* * * * *